United States Patent [19]

Bishop et al.

[11] Patent Number: 4,939,978

[45] Date of Patent: Jul. 10, 1990

[54] AMMUNITION CHUTING FOR A MACHINE GUN

[75] Inventors: Frederick J. Bishop, Codsall; David T. Cooper, Fallings Park; William H. Hill, Willenhall, all of United Kingdom

[73] Assignee: Lucas Industries Public Limited Co., West Midlands, England

[21] Appl. No.: 328,868

[22] Filed: Mar. 27, 1989

[30] Foreign Application Priority Data

Mar. 31, 1988 [GB] United Kingdom ..... 8807714

[51] Int. Cl.[5] ..... F41A 9.79

[52] U.S. Cl. ..... 89/33.14; 89/33.2; 193/25 AC

[58] Field of Search ..... 89/33.14, 33.16, 33.2, 89/33.25, 34, 33.01; 193/25 AC

[56] References Cited

U.S. PATENT DOCUMENTS

| | | | |
|---|---|---|---|
| 2,007,774 | 7/1935 | Sedgley et al. . | |
| 2,351,370 | 6/1944 | Schaaf | 193/25 AC |
| 2,419,315 | 4/1947 | Elliot . | |
| 2,464,689 | 3/1949 | Jackson . | |
| 2,477,264 | 7/1949 | Pearson | 193/25 AC |
| 2,550,837 | 5/1951 | MacKenzie . | |
| 2,568,229 | 9/1951 | Gardes | 193/25 AC |
| 2,740,180 | 4/1956 | Nobles . | |
| 2,890,779 | 6/1959 | Aumann | 193/25 AC |
| 2,915,947 | 12/1959 | Heeley . | |
| 3,788,189 | 1/1974 | Sachleben, Sr. et al. | 89/34 |
| 4,301,711 | 11/1981 | Vonlanthen et al. . | |
| 4,338,851 | 7/1982 | Bremer et al. . | |
| 4,669,355 | 6/1987 | Schmid et al. | 193/25 AC |
| 4,674,393 | 6/1987 | Schaulin et al. | 89/33.14 |
| 4,762,049 | 8/1988 | Hughes | 89/33.14 |

FOREIGN PATENT DOCUMENTS

| | | | |
|---|---|---|---|
| 2436960 | 4/1980 | France | 193/25 AC |
| 572504 | 10/1945 | United Kingdom | 89/33.01 |
| 574994 | 1/1946 | United Kingdom | 89/33.2 |
| 624358 | 6/1949 | United Kingdom | 89/33.2 |

*Primary Examiner*—Charles T. Jordan
*Assistant Examiner*—Stephen Johnson
*Attorney, Agent, or Firm*—Mattern, Ware, Stoltz & Fressola

[57] ABSTRACT

A flexible ammunition chuting (14) for a machine gun (10) includes a flexible spine (26) made up of spring steel strips (27, 29) which are anchored at two spaced and fixed positions, typically at the chuting ends, so as precisely to define the length of the chuting. The chuting includes relatively articulated links (20), which are able to follow convex and concave bends and to twist torsionally, but the spine (26) prevents the overall stretching or collapse of the links, which might result in ammunition belt misfeed or jamming.

5 Claims, 6 Drawing Sheets

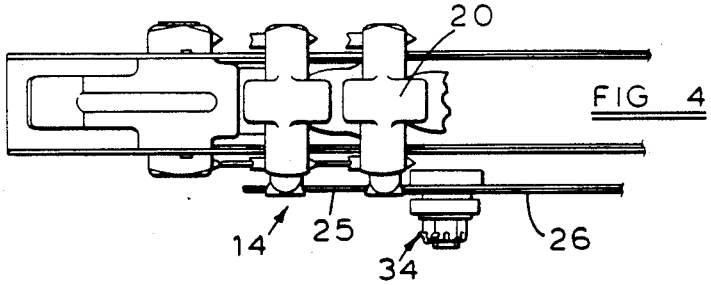
FIG 4
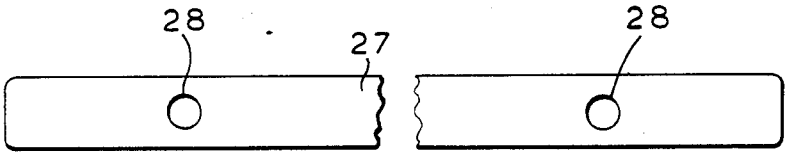
FIG 6
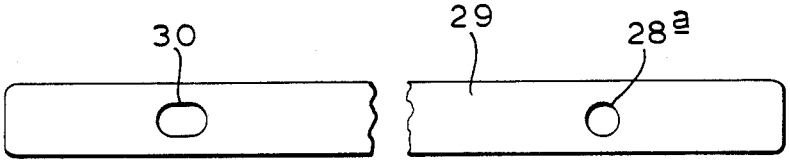
FIG 7
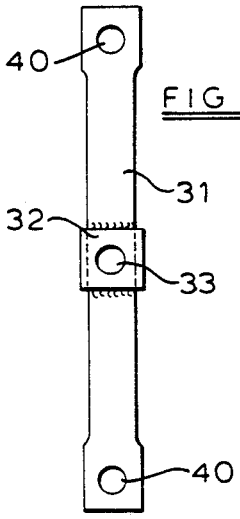
FIG 8
FIG 9
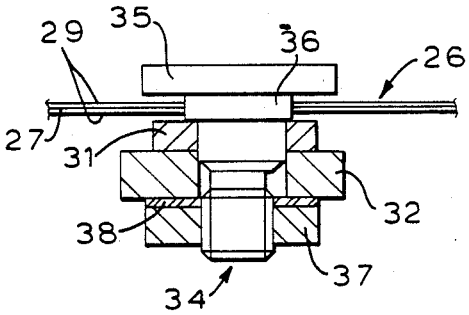

AMMUNITION CHUTING FOR A MACHINE GUN

BACKGROUND OF THE INVENTION

1. Field of the Invention

This invention relates to flexible ammunition chuting for feeding ammunition to a machine gun.

2. Description of the Prior Art

In our prior European patent application number 0,230,111, there is described a feed system for supplying a belt of linked ammunition to a traversable gun which is mounted for wide angle movement. Such a gun may have an angle of azimuth varying as much as 200° and may also be required to tilt upwardly and downwardly by for example 15° and 45° respectively.

Ammunition cartridges supplied to the gun are linked in the form of a belt or clipped side by side and are guided to the firing chamber of the gun by flexible chuting which must be sufficiently long to allow for the movement of the gun to any position in its range of movement, any slack in the chuting forming a loop as described in our prior patent specification.

It has been found that, because of the construction of the flexible chuting in the form of relatively slidable and articulating links, the links may close up together or become over stretched in response to forces resulting from movement of the gun and turret. This leads to loss of flexibility of the chuting which in turn could lead to ammunition jams or to restriction of the travel of the gun.

BRIEF SUMMARY OF THE INVENTION

It is an object of the present invention to provide, in combination with a flexible ammunition chuting of generally known type, a means for preventing or reducing the foregoing problem.

According to the invention there is provided a flexible ammunition chuting for a machine gun, having a plurality of loosely connected relatively slidable and articulated links, and a flexible spine linked to the chuting throughout a portion of its length between two points, the spine defining the distance between said two points of the chuting to prevent collapse or stretching of said portion, while permitting flexural and torsional bending of the chuting.

The spine may be connected at said two points to respective support means.

The spine may be located relative to, but unsecured to the chuting at said two points.

The spine may be attached to a fixing member located between, but unsecured to, two or more adjacent links of the chuting.

The spine may be non-rigidly attached to the fixing member by location but without clamping.

The spine may have a plurality cf location elements, each associated with a respective link, adapted collectively to locate and link the spine to the chuting throughout the portion of its length between said two points.

The spine may comprise a spring steel strip, or a plurality of spring steel strips. Where a plurality of strips is used, some relative movement between the strips may be allowed for in the means of securing the strips at said two points.

BRIEF DESCRIPTION OF THE SEVERAL VIEWS OF THE DRAWINGS

An embodiment of the invention will now be described in more detail by way of example only with reference to the accompanying drawings in which:

FIG. 4 is a plan view of the chuting shown in FIG. 3.

FIG. 6 is a partial elevational view of part of a flexible spine.

FIG. 7 is a similar view to FIG. 6 showing another portion of flexible spine.

FIG. 8 is a front elevational view of a fixing member comprising a finger plate also shown in FIGS. 3 and 4 of the drawings.

FIG. 9 is an enlarged sectional view of a fixing for the finger plate of FIG. 8, the fixing also being shown in FIGS. 3 and 4.

DETAILED DESCRIPTION OF THE PREFERRED EMBODIMENT

Figure 1:
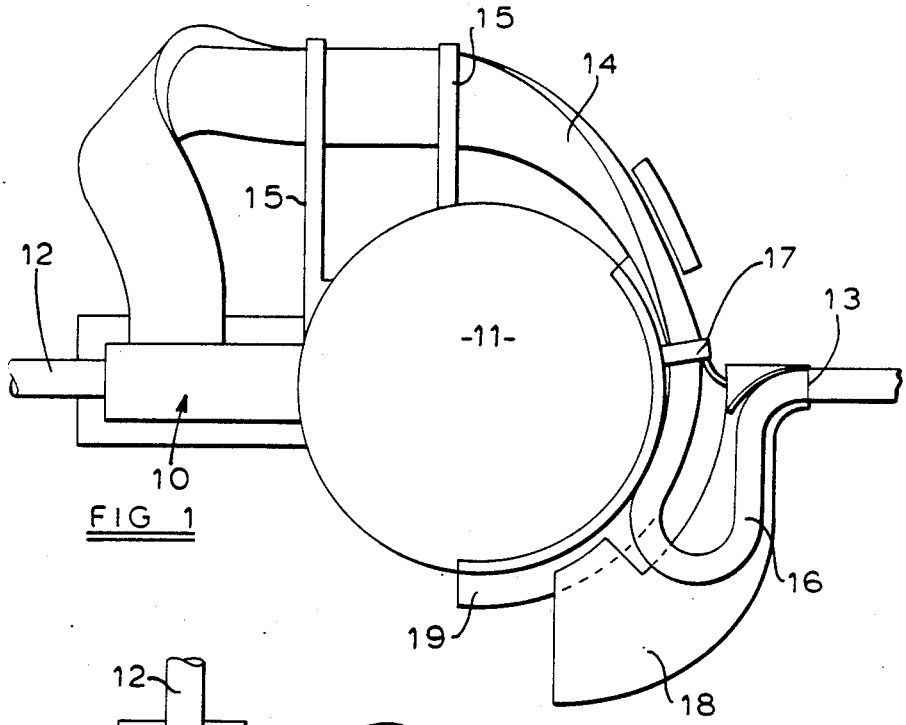
FIG. 1 is a plan view of a gun turret showing a gun in a forwardly directed condition.
Figure 2:
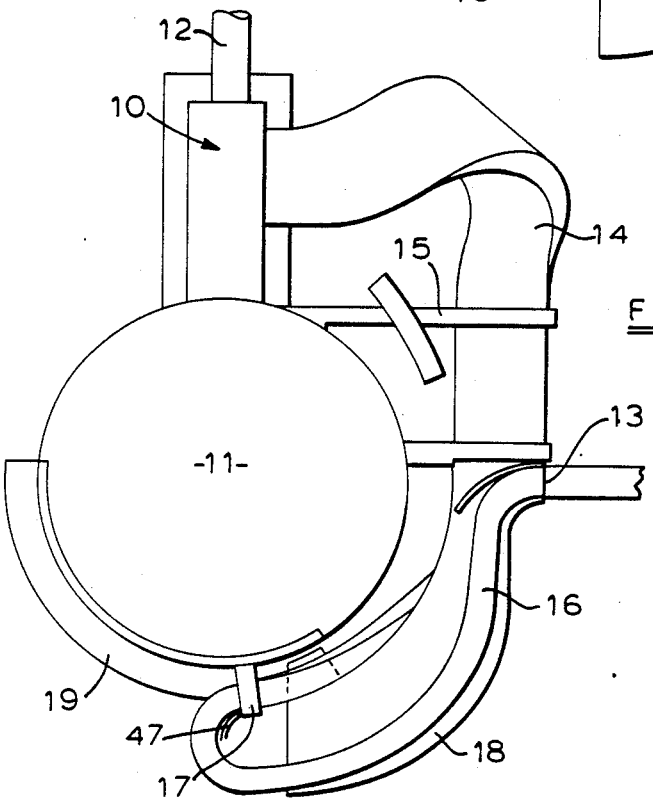
FIG. 2 is a similar plan view showing the gun in a laterally directed condition.

Referring firstly to FIGS. 1 and 2 of the drawings, a machine gun generally indicated at 10 is mounted for movement on a gun turret 11 which is mounted beneath the fuselage of an aircraft such as a helicopter. In FIG. 1 of the drawings, a barrel 12 of the gun is pointing forwardly away from the aircraft. In FIG. 2 the barrel has been rotated through 90° to extend laterally. It could equally well be turned through 90° in the opposite direction.

In order to accommodate these wide movements of the gun barrel and also up and down tilting movements which may take place, the ammunition for the gun must be guided from the point 13 which is the end of a live ammunition conduit mounted on the aircraft, so as to enter the firing chamber of the gun, irrespective of its position.

This guidance is achieved by means of flexible chuting 14, through which the ammunition is transported with the rounds disposed side by side and held together by a belt or by means of articulated clips. For convenience, the ammunition will be referred to as a "belt".

The flexible chuting 14 is supported adjacent to the gun on arms 15. However in order to accommodate movement of the gun and turret, it is necessary to allow a sufficient length of the inboard portion of the chuting to adopt a looped form, the loop 16 being relatively large when the gun is pointed laterally as shown in FIG. 2, rather smaller when the gun is trained forwardly as shown in FIG. 1, and reducing to a negligible size when the gun reaches its full lateral travel in the opposite direction of rotation (not shown).

The inboard end of the chuting is fixed at 13 relative to the conduit. A portion of the chuting is attached at 17 to the gun turret. The intervening part of the chuting forms the loop 16, which is supported by a fixed plate 18 secured to the aircraft and also by a flange 19 secured to the turret. It will be seen that the relative positions of the support plate 18 and flange 19 change as the gun 10 is traversed.

Figure 3:
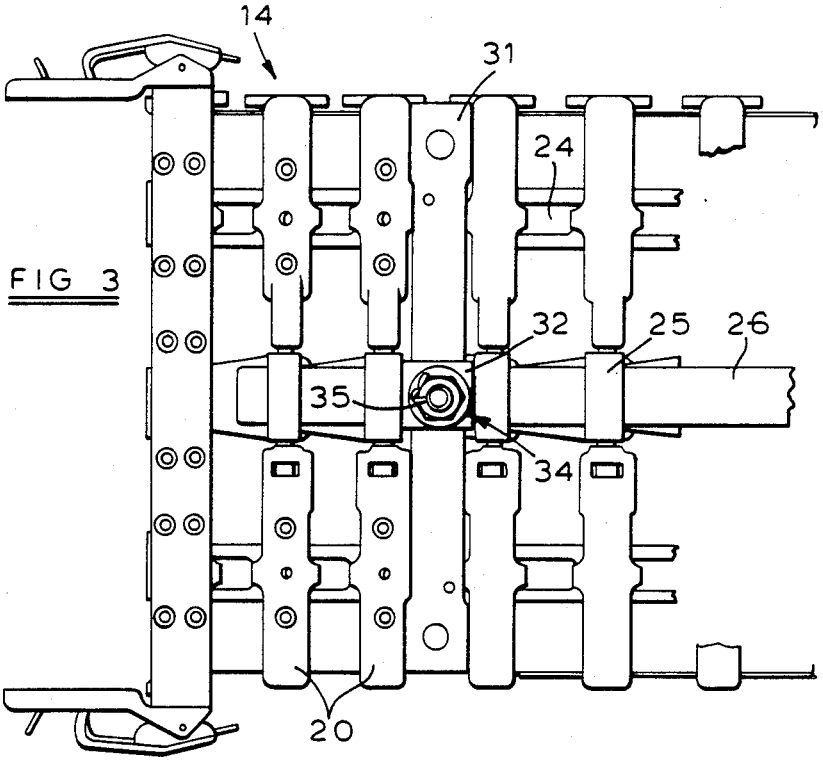
FIG. 3 is a side elevational view of an inboard portion of ammunition chuting of the gun shown in FIGS. 1 and 2, in combination with a flexible spine.
Figure 5:
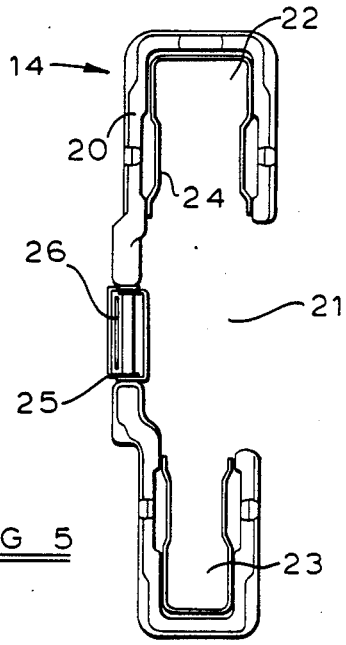
FIG. 5 is an end elevational view of the chuting shown in FIG. 3.

The chuting is formed as a series of identical articulated links which can be seen in FIGS. 3 to 5 of the drawings. Each link 20 is of generally C shape having an open side at 21 and broader and narrower internal cross sections 22 and 23, to conform with the ammunition belt (not shown) passing through the chuting. The links 20 are connected loosely together by stainless steel plates 24 which have a sliding engagement and which are hooked one into another and which present a smooth internal profile, over which the ammunition belt can pass at high speed. The links 20 are capable of moving towards and away from each other to a limited extent from a nominal pitch separation of for example 25 mm. In such chuting, a problem may arise when the links are compressed together or urged apart to the limit. In these conditions, the flexibility of the belt is very severely reduced.

The present invention has been devised to ensure that the loop 16 of the flexible chuting is prevented from becoming compressed or collapsed or over-stretched, in response to movements of the gun and turret, throughout the length between the attachment at 13 to the conduit 13 and at 17 to the turret. Such distortions in the length of the chuting which reduce or increase the pitch between links can impose resistance to flexing of the chuting and could cause ammunition jams or restrict movement of the gun. The links may also undergo limited angular relative movement so that the chuting as a whole can curve round convex or concave bends and can also twist torsionally.

The basic chuting is known and forms no part of the present invention.

However it is modified in the form shown in the drawings by the addition of rotatably mounted bridge pieces 25 which are loosely pivoted on the links 20 at a central position and which lie outside the C shape of the chuting section.

The bridge pieces 25 receive a flexible supporting spine 26 which is intended to support the links 20 against collapse on small radius bends.

The flexible spine 26 is intended to stop the links from either jamming together or being too widely separated as the chuting adopts different configurations according to the movement of the gun 10. Between the points 13 and 17 shown in FIGS. 1 and 2 of the drawings, the overall length of the chuting is maintained constant by the flexible spine. This allows the chuting to bend into the necessary loops and twists and tends to smooth out the effect of any very sharp bends, preventing collapse of the links against each other or over-stretching. The spine 26 is not connected at any point between its two ends to the links 20 of the chuting. It is merely constrained within the bridges 25. All the load exerted on the spine 26 is transferred to its two ends which are secured by support means to be described in relation to FIGS. 3 and 4 and FIGS. 11 and 12. The support means transfer the loading of the spine direct to major structural masses namely to the fixed support plate 18 and to the turret structure 11 without loading the articulated chuting itself.

Turning to FIGS. 6 and 7 of the drawings, the flexible spine 26 is made up of three thin gauge spring steel strips. One strip 27 shown in FIG. 6 has a pair of circular attachment holes 28 at its opposed ends, intended to be attached to the support means.

The remaining two stainless steel strips forming the flexible spine 26 are as shown in FIG. 7 of the drawing at 29. Each of these has a round hole **28*a* and a slightly elongated hole 30 for attachment to the support means. In this embodiment, the elongate holes 30 are positioned one at each end of the spine. The flexible spine 26 adopts a sandwich construction having one of the strips 29 at each outer face with the strip 27 sandwiched between. This permits slight relative adjustment of the strips forming the spine 26 to allow for bending while still maintaining the exact spacing of the points 13 and 17** where the support means are positioned. The rise of more than one strip in this relatively adjustable relationship provides strength to the spine without substantial restriction of flexibility.

Turning to the construction of the support means, the inboard end of the chuting 14 is connected at 13 to the live ammunition conduit and undergoes rather lesser stresses than the outboard end attached to the turret at 17. This is reflected in the support means used.

Figure 10:
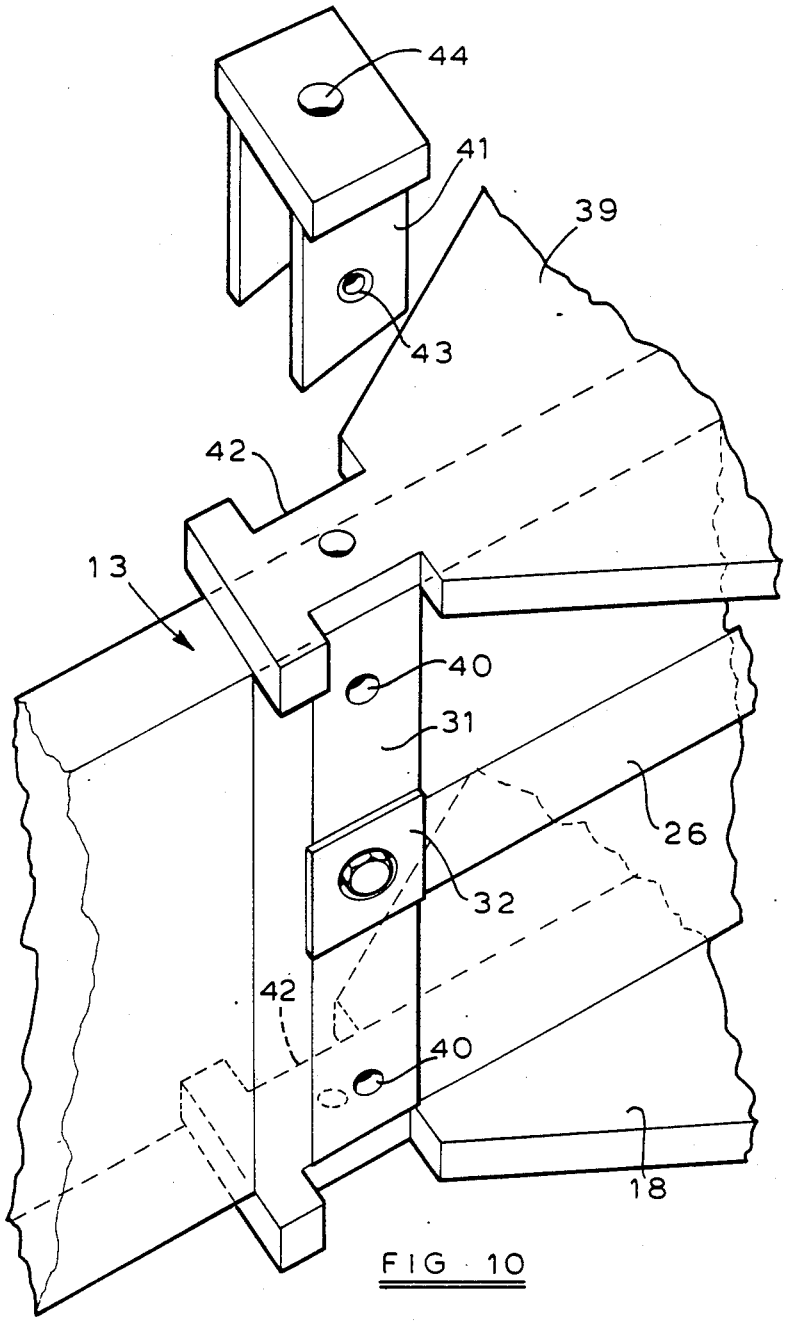
FIG. 10 is an exploded isometric view of the manner of fixing the inboard end of the chuting using the finger plate of FIG. 8.

At the inboard end, the arrangement is as shown in FIGS. 3 and 4 of the drawings and uses a finger plate 31 shown in FIG. 8. The finger plate has a pad 32 welded to its centre, carrying a bolt hole 33 which is the sole point of attachment to the inboard end of the flexible spine 26, being bolted through holes 28, **28*a* and 30 of the strips 27 and 29. The bolting arrangement is shown in FIGS. 9 and 10 and it will be seen that, the strips 27 and 29 are not clamped tightly to the finger plate 31. A locator 34 (see FIGS. 4 and 9) has a head 35 against which the spine 26 is located around a shoulder 36 which spaces the head 35 from the finger plate 31. A nut 37 and washer 38 are used to secure the assembly together, the nut being applied from the outer face of the chuting as most clearly seen in FIG. 4**.

Although not illustrated in detail, a similar arrangement to that shown in FIG. 9 is used to clamp the other end of the spine 26 to the outboard fixing at 17 to the turret.

The finger plate 31 itself is not secured to the chuting 14 but is secured to the fixed structure at 13, adjacent the live ammunition conduit. The arrangement is illustrated in FIG. 10.

At the live ammunition conduit, the loop 16 of chuting is supported on a fixed support plate 18 as previously referred to. A similar fixed plate (not shown in FIGS. 1 and 2 of the drawings), overlies the chuting and this is shown at 39 in FIG. 10. The drawing also diagrammatically shows the finger plate 31 and its strengthening pad 32 together with the inboard portion of the flexible spine 26 and the end of the live ammunition conduit.

Each end of the finger plate 31 has a bolt hole 40. A fixing fork 41 is lowered as shown into a pair of location rebates 42 of the top support plate 39 and bolted at 43 to the upper bolt hole 40 of the finger. A similar lower fixing fork (not shown) is bolted to the lower bolt hole 40 from underneath the bottom support plate 18. The bridging webs of the upper and lower fork are bolted respectively by means of the bolt holes 44 to the upper and lower support plates 39 and 18. Thus, the arrangement is that the flexible spine 26 is attached only to the centre of the finger plate and not attached at any other point along the chuting loop 16, and the finger plate 31 is attached only to the top and bottom support plates 39 and 18 which are rigid with the structure of the aircraft, and the finger plate 31 is not attached to the flexible chuting.

Turning to FIGS. 3 and 4, it will be seen that the flexible chuting affords recesses between the adjacent links 20. It is in one of these recesses that the finger plate is located, between the second and third links 20 of the chuting at the inboard end.

In principle, the attachment of the outboard end to its support means on the turret 11 is similar to that previously described in relation to the inboard end. However, because the flexural stresses to be expected at the turret are greater, a slightly broader support means is used so as to spread the loading in a somewhat less concentrated fashion.

Figure 12:
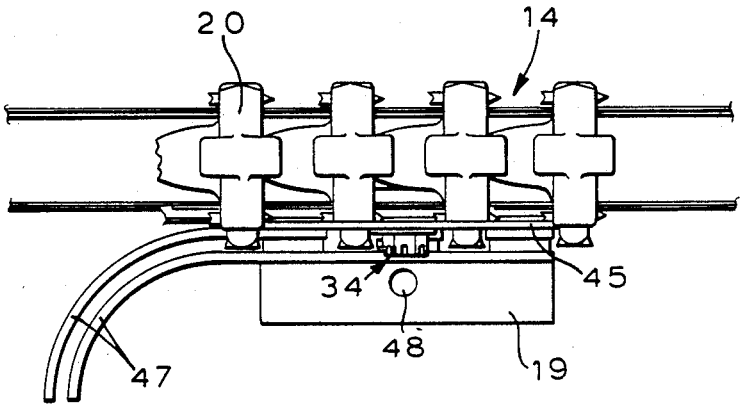
FIG. 12 is a plan view of the portion of chuting shown in FIG. 11.
Figure 13:
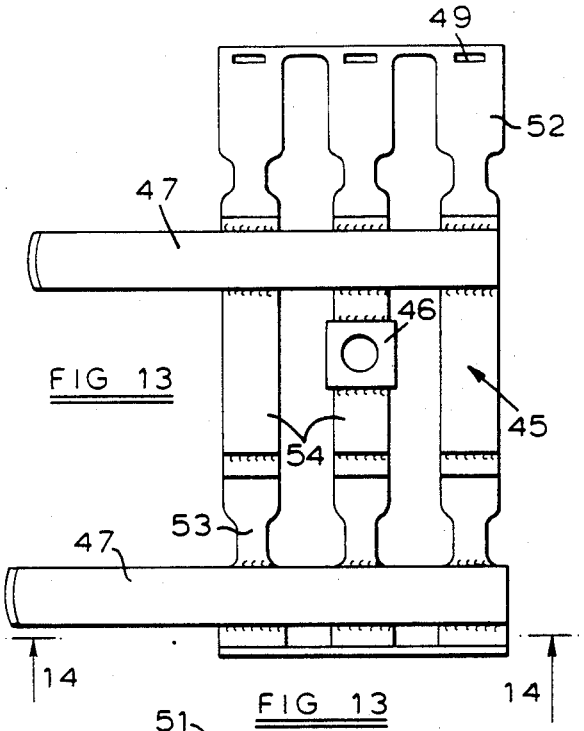
FIG. 13 is a front elevational view of a triple-finger plate also shown in FIGS. 11 and 12.
Figure 15:
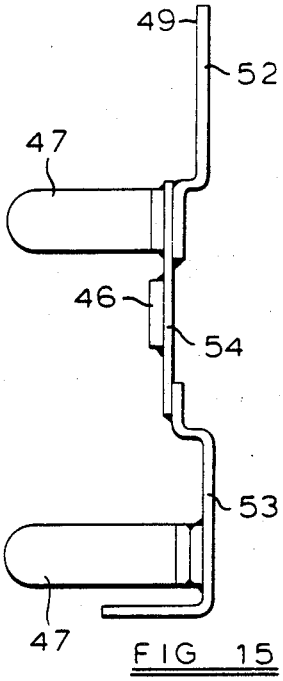
FIG. 15 is an end elevational view of the triple-finger plate shown in FIGS. 13 and 14.
Figure 14:
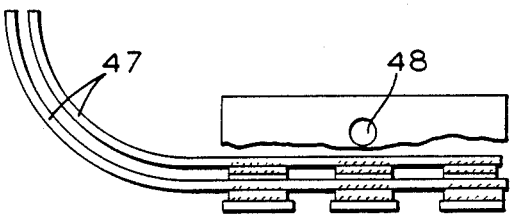
FIG. 14 is a section on the line 14—14 of FIG. 13.

The outboard portion of chuting is attached at 17 to the turret by means of a triple finger plate 45 shown in FIGS. 13 to 15 of the drawings. Each part of the triple finger plate 45 comprises a finger somewhat similar to that shown in FIG. 8 but the three fingers are connected integrally together. A pad 46 is welded to the central finger and a bolted connection as shown in FIG. 9 is used to secure on the flexible spine 26, the connection being shown in FIGS. 11 and 12 of the drawings.

In addition to the fingers themselves, the triple finger plate 45 carries a pair of curved radius guides 47 which also assist in defining the minimum radius through which the chuting can be bent at the outboard end 17 where it is secured to the turret.

Figure 11:
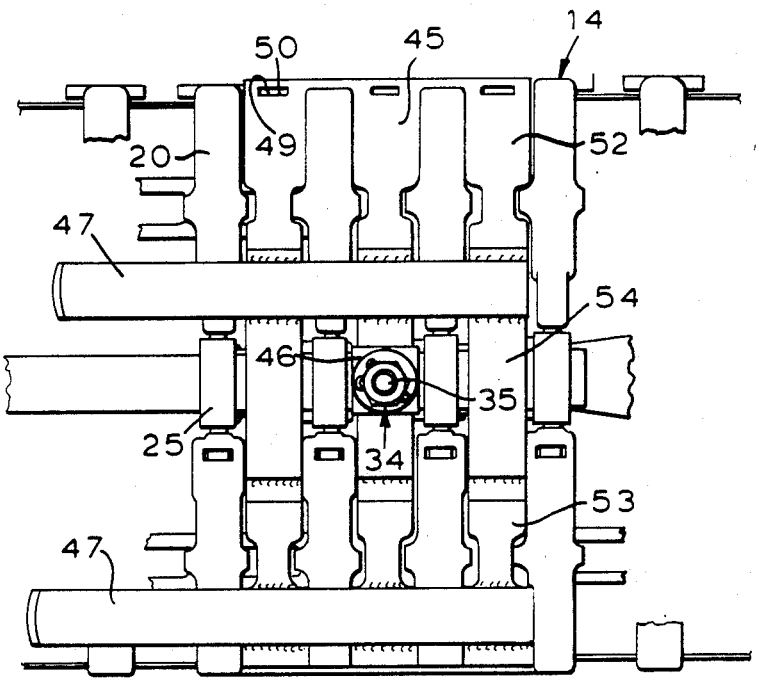
FIG. 11 is a front elevational view of an outboard portion of the chuting.
Figure 16:
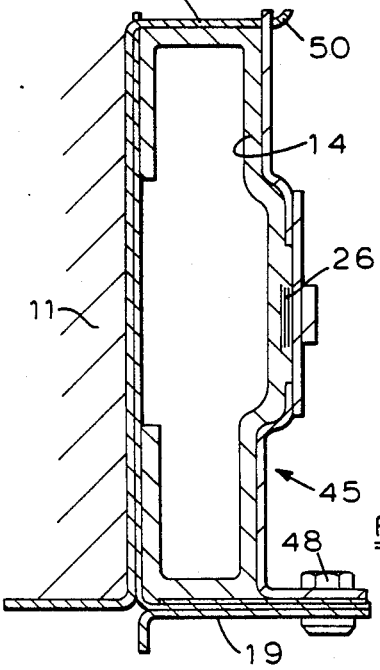
FIG. 16 diagrammatically illustrates the manner of fixing the triple-finger plate at the outboard end of the portion of chuting.

The triple finger plate 45 is mounted within the recesses between the 37th, 38th, 39th and 40th links of the chuting as shown in FIGS. 11 and 12. Again, the triple finger plate 45 is not actually secured to the chuting at this point but is merely located. FIG. 16 diagrammatically shows the support means for the chuting.

In FIG. 16, the turret 11 carries a generally L shape flange 19. The triple finger 45 is bolted at 48 to this flange 19. The upper end of the triple finger 45 has a series of three slots 49 which receive prongs 50 of a trifurcated attachment plate 51 secured to the turret 11. Thus, the chuting indicated diagrammatically at 14 is enclosed within the assembly of the triple finger 45, the flange 19 and the trifurcated attachment plate 51 but is not rigidly secured to this assembly.

It will therefore be seen that, at the moving outboard end of the chuting loop 16, where loading is expected to be higher, the forces transferred through the flexible spine 26 are carried back to the structure of the turret 11 through the flange 19 and trifurcated attachment plate 51.

For simplicity, the triple finger 45 has been referred to as a single integral item but it is manufactured in upper and lower parts 52, 53 welded to central finger elements 54, and also welded to the radius guides 47 previously referred to. The attachment pad 46 is welded to the centre of the central finger element 54.

We claim:

1. A flexible ammunition chuting for a machine gun, the chuting being capable of flexural bending in all planes perpendicular to a central axis extending along a length of the chuting and of torsional bending about said central axis;

the chuting comprising a plurality of loosely connected relatively slidable and articulated links, a fixing member being provided at each of two points defined on the chuting, each said fixing member being located between, but unsecured to a plurality of adjacent links of the chuting;

and a non-compressible flexible strip-like spine linked between said two points to the articulated links throughout a portion of the length of the chuting, the spine being non-rigidly attached to each said fixing member, the spine defining a distance between said two points as measured along a path of the spine to prevent change of said distance, while permitting said flexural and torsional bending of the chuting.

2. A chuting according to claim 1 wherein a plurality of location elements are provided on the spine, each location element being associated with a link and the spine being linked to the chuting throughout said distance between said two points by said plurality of location elements.

3. A chuting according to claim 1 wherein the spine comprises a spring steel strip.

4. A chuting according to claim 3 wherein the spine comprises a plurality of spring steel strips.

5. A chuting according to claim 4 wherein the strips are secured at said two points by means allowing some relative movement between the plurality of strips.

* * * * *